United States Patent [19]

Marple

[11] 4,095,798

[45] Jun. 20, 1978

[54] GOLF GAME PRACTICE DEVICE

[76] Inventor: Walter G. Marple, 17 Beech Pl., Woodbury, N.J. 08096

[21] Appl. No.: 707,629

[22] Filed: Jul. 22, 1976

[51] Int. Cl.[2] ..... A63B 69/36

[52] U.S. Cl. ..... 273/200 R; 273/185 C; 273/58 C

[58] Field of Search ..... 273/200 R, 200 A, 198, 273/185 C, 184 B, 58 C; 119/121

[56] References Cited

U.S. PATENT DOCUMENTS

| | | | |
|---|---|---|---|
| 883,058 | 3/1908 | Sprague | 273/198 |
| 1,326,976 | 1/1920 | Schnurr | 273/200 R |
| 1,500,183 | 7/1924 | Dall | 273/184 B |
| 1,700,224 | 1/1929 | Hendersen | 119/121 |
| 1,982,808 | 12/1934 | Hendersen | 273/185 C |
| 2,032,081 | 2/1936 | Deane et al. | 273/200 R |
| 3,100,476 | 8/1963 | Peak | 119/121 |
| 3,430,493 | 3/1969 | Wall | 273/185 C X |
| 3,502,337 | 3/1970 | Butkus | 273/200 R |
| 3,521,887 | 7/1970 | Butkus | 273/200 R |

FOREIGN PATENT DOCUMENTS

| | | | |
|---|---|---|---|
| 18,844 of | 1891 | United Kingdom | 273/200 R |
| 3,393 of | 1896 | United Kingdom | 119/121 |

*Primary Examiner*—George J. Marlo
*Attorney, Agent, or Firm*—Pennie & Edmonds

[57] ABSTRACT

A heavy duty metal stake with a helical screw portion that is turned into the ground. A heavy rubber strap is connected between a swivel member on the stake and one end of a length of nylon cord. The other end of the cord is removably attached to a staple imbedded in a standard wound rubber core golf ball.

4 Claims, 5 Drawing Figures

12
10
14
16
18
20
21
22
22A
23A
23B
24
24A
24B
26
28
2
4

GOLF GAME PRACTICE DEVICE

SUMMARY OF THE INVENTION

This invention is an easily portable, rugged and simple to use golf practice device comprised of a single anchoring stake having a helical screw portion that is easily turned into or out of the ground by its handle yet will not pull out even when the device is used by the strongest hitters. A swivel member is secured at the shank of the stake between the handle and screw portion and is free to rotate about the longitudinal axis of the stake. A heavy rubber strap is attached between the swivel member and one end of an approximately 20 foot length of non-elastic nylon cord. The other end of the cord is removably attached to a staple imbedded in a standard wound rubber core golf ball.

The invention overcomes the disadvantages of the prior art through the use of a simple rugged anchoring stake that permits safe use in a variety of places and is especially useful for warm-up practice prior to commencement of a game at the golf course. The rubber strap has sufficient elasticity to safely arrest the flight of the ball, but does not return the struck ball toward the player in a dangerous manner. In addition, the direction of the return of the ball is indicative of what its unarrested flight would have been i.e., for a right-handed golfer, a return to the right of the stake indicates hooking or pulling; a return to the left indicates slicing or pushing; and a straight return indicates a straight shot.

The invention also has the great advantage of using conventional wound core golf balls that enable the player to practice with the same type of ball that he ordinarily uses in regular play.

DESCRIPTION OF THE PREFERRED EMBODIMENT

Figures 1, 2, 3, 4, 5:
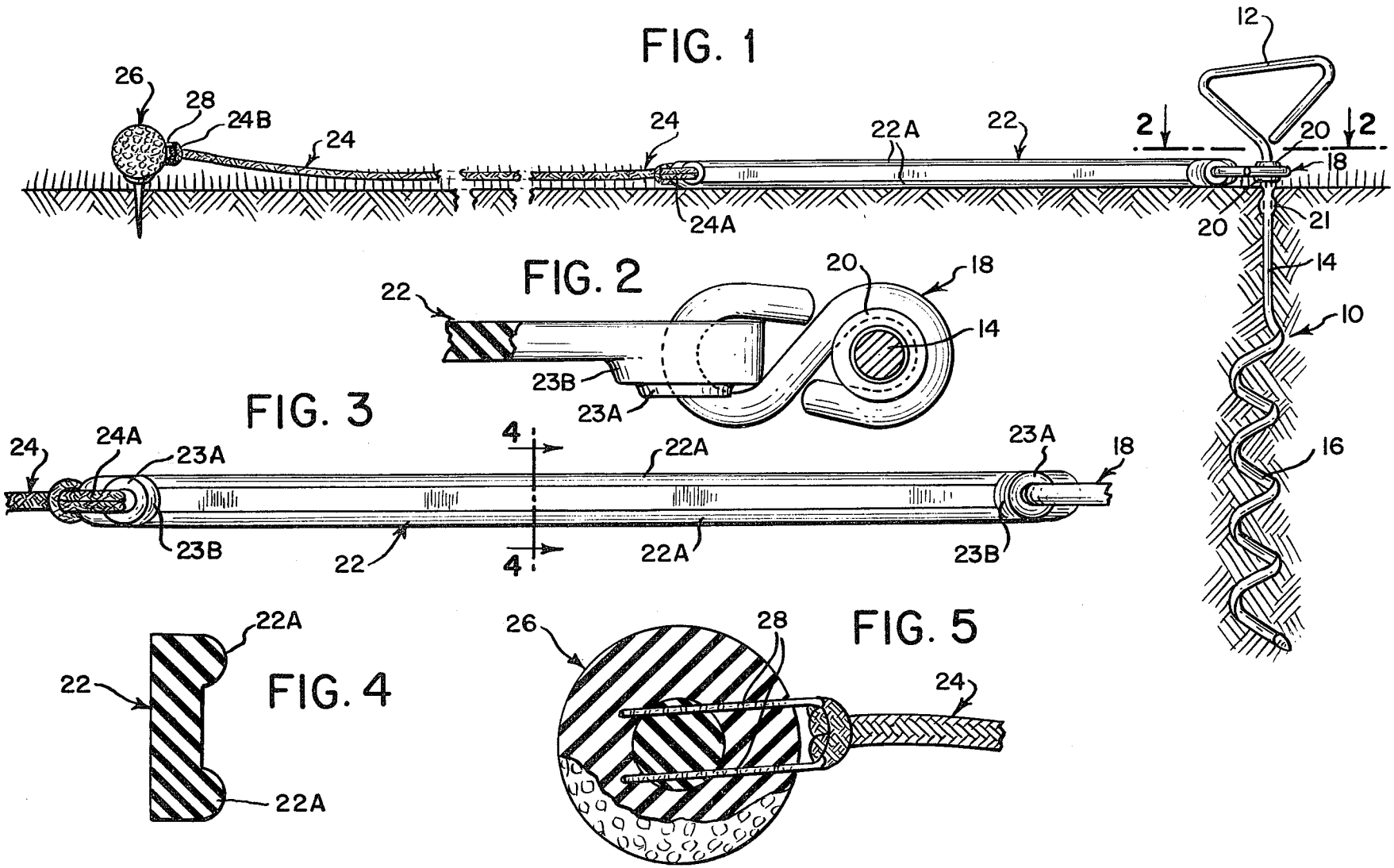
FIG. 1 is a view showing the assembled elements of the practice device of the invention.
FIG. 2 shows the swivel member employed in the preferred embodiment.
FIG. 3 is a side view of the rubber strap employed in the preferred embodiment.
FIG. 4 is a cross-sectional view of the rubber strap of the preferred embodiment taken along the line 4—4 in FIG. 3.
FIG. 5 is a cross-sectional view of a conventional wound rubber core golf ball showing the staple imbedded therein.

Referring to FIG. 1 there is shown an anchoring stake 10 having a handle portion 12 a shank portion 14 and a helical screw portion 16. A swivel member 18 on the shank portion 14 is free to rotate about the longitudinal axis of the stake. The swivel member 18 is secured to one end of the rubber strap 22 through a reinforced hole therein. The other end of the strap 22 is removably attached to one end of nylon cord 24, preferably by passing eye splice 24A through the reinforced hole in that end of the strap 22 and looping the cord 24 through the splice in the known manner. Alternatively the cord 24 may be attached to strap 22 by tying it with a suitable knot. Finally, a conventional wound rubber core golf ball 26 is secured to the other end of the cord by staple 28 imbedded therein. Again the eye splice-loop method is preferred for attaching the cord to the staple.

The anchor stake 10 is preferably constructed from a $\frac{3}{8}$ inch diameter light steel rod or other metal of equivalent strength. In the preferred embodiment the stake is approximately 18 inches in overall length and has a helical screw section approximately $9\frac{1}{2}$ inches long with a diameter of about $1\frac{1}{2}$ inches. The end of screw 16 is sharpened to facilitate turning the stake into the ground.

Referring now to FIG. 2 the swivel member 18 of the preferred embodiment is shown. The swivel is a $2\frac{1}{2}$ inch heavy duty "S" hook 18, one loop of which is secured around shank 14 between two washers 20. The swivel assembly is located at the shank portion 14 of the stake by the angle of the handle 12 at the upper end of the shank and by flattened ears 21 on the shank. The other loop of the "S" hook is secured through the reinforced hole at the end of rubber strap 22.

Referring now to FIG. 3 there is shown a front view of the rubber strap 22 employed in the preferred embodiment. Strap 22 is between about 9 inches and 15 inches in length and is preferably 15 inches long. In the preferred embodiment the holes at either end of the strap are reinforced by lands 23A and 23B molded in the rubber that provide a double thickness in the region of the holes. The preferred strap also has ridges 22A on its front side as shown in FIG. 3. These ribs are also shown in the cross-sectional view of FIG. 4. As can be seen in FIG. 4 the trap 22 is substantially rectangular in cross-section and in the preferred embodiment is about $\frac{3}{4}$ inches wide and $\frac{1}{4}$ inch thick.

Referring now to FIG. 5 there is shown a cross-section of a conventional wound rubber core golf ball 26 with the securing staple 28 imbedded therein. A staple formed of 1/16 inch wire imbedded along a great circle of the ball at a depth greater than the radius of the ball toward the center of the ball, will adequately secure the ball to the cord. In the preferred embodiment a $1\frac{1}{2}$ inch long 1/16 inch staple is driven to a depth of 1 inch into a standard $1\frac{3}{4}$ inch diameter wound core golf ball.

The cord 24 of the preferred embodiment is between 18 and 25 feet in length and preferably is a 22 foot cord of $\frac{1}{8}$ inch nylon. It has eye splices 24A and 24B at either end for securing the cord to the strap 22 and the staple 28 respectively.

To use the practice device of the invention, the player selects an unobstructed area that will permit extension of the cord to twice its full length. In the preferred embodiment an area about 46 feet long and of reasonable width is adequate. The stake is turned into the ground at the center of this area to a depth, sufficient to prevent the stake from being pulled out by its handle, which will depend on the relative softness of the ground. The ball is then taken to the full length of the cord in a direction opposite that in which the ball is to be struck. The ball may be hit from a tee or directly from the ground depending upon the golf club with which the player wishes to practice. The ball is struck so as to have its intended natural path of flight over the stake. The length of the cord of the invention is such that the flight of the ball may be readily observed and because only a single cord is used the flight is relatively unaffected.

A unique feature of the invention is that a player can determine the type of hit made by the diection that the ball is returned by the elastic action of the strap. For example, for a right-handed player; if the ball returns to the right of the stake, the hit was a hook or pulling of the ball; if the ball returns to the left of the stake, the hit was a slice or pushing of the ball; and if the ball returns directly over the stake the ball was hit straightaway.

I Claim:

1. A golf game practice device comprising:

(a) an anchoring stake having a handle portion, a shank portion and a helical screw portion adapted to be turned into the ground;

(b) a swivel member located at said shank portion and adapted to rotate arond the longitudinal axis thereof;

(c) one end of an elongated elastic member attached to said swivel member;

(d) one end of an at least 18 foot length of cord removably attached to the other end of said elongated elastic member; and (e) the other end of said cord removably attached to a staple imbedded in a wound rubber core golf ball adapted to be driven by a golf club in a natural line of flight across said stake.

2. The game device of claim 1 wherein said elongated elastic member is a rubber strap having a reinforced hole at either end.

3. The game device of claim 2 wherein said rubber strap is between about 9 inches and about 15 inches in length and has a substantially rectangular transverse cross-section about $\frac{1}{4}$ inch thick and $\frac{3}{4}$ inches wide.

4. The game device of claim 1 wherein said stake is constructed from a metal rod about $\frac{3}{8}$ inches in diameter, the helical screw portion being about $1\frac{1}{2}$ inches in diameter, about $9\frac{1}{2}$ inches long and having about $4\frac{1}{2}$ turns.

* * * * *